US010216135B2

(12) United States Patent
Miyakawa

(10) Patent No.: US 10,216,135 B2
(45) Date of Patent: Feb. 26, 2019

(54) IMAGE FORMING APPARATUS HAVING INSERTION PORTION AND RECEIVING PORTION TO CONNECT FRAMES, AND SHEET TRANSFER APPARATUS THEREOF

(71) Applicant: CANON KABUSHIKI KAISHA, Tokyo (JP)

(72) Inventor: Shogo Miyakawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 25 days.

(21) Appl. No.: 15/204,362

(22) Filed: Jul. 7, 2016

(65) Prior Publication Data

US 2017/0010578 A1 Jan. 12, 2017

(30) Foreign Application Priority Data

Jul. 10, 2015 (JP) ..... 2015-138440

(51) Int. Cl.
*G03G 21/16* (2006.01)

(52) U.S. Cl.
CPC ..... *G03G 21/1619* (2013.01)

(58) Field of Classification Search
CPC ..... G03G 21/1619
USPC ..... 399/107
See application file for complete search history.

(56) References Cited

U.S. PATENT DOCUMENTS 2,318,234 A * 5/1943 Kluger ..... A45C 13/08 40/622
3,062,261 A * 11/1962 Chesser ..... B21D 39/03 29/238
2015/0098727 A1* 4/2015 Yano ..... G03G 21/1647 399/107
2016/0016221 A1* 1/2016 Dubugnon ..... B21D 39/031 29/243.5
2016/0023794 A1* 1/2016 Seon ..... B65C 7/00 29/505

FOREIGN PATENT DOCUMENTS

JP 59-42598 U 3/1984
JP H11-135956 A 5/1999
JP 2014-009699 A 1/2014
JP 2014-013081 A 1/2014

* cited by examiner

*Primary Examiner* — Walter L Lindsay, Jr.
*Assistant Examiner* — Philipmarcus T Fadul
(74) *Attorney, Agent, or Firm* — Canon U.S.A., Inc. IP Division

(57) ABSTRACT

An image forming apparatus includes a housing having a plurality of frames. At least one of the plurality of frames is a box-shaped frame with bent portions. The box-shaped frame has a first surface and a second surface overlapping the first surface, where the first surface has an insertion portion and the second surface has a receiving portion into which the insertion portion is configured to be inserted. The first surface and the second surface are connected to each other by insertion of the insertion portion in the receiving portion.

17 Claims, 7 Drawing Sheets

IMAGE FORMING APPARATUS HAVING INSERTION PORTION AND RECEIVING PORTION TO CONNECT FRAMES, AND SHEET TRANSFER APPARATUS THEREOF

BACKGROUND OF THE INVENTION

Field of the Invention

The present invention relates to an image forming apparatus and a sheet transfer apparatus connected to the image forming apparatus.

Description of the Related Art

Frames making up a housing of an image forming apparatus are formed of sheet metal in some cases. In such cases, some frames may be formed into a box-shaped frame, and overlapping portions of the box-shaped frame may be fixed with a screw or by welding so as to form the housing. In a technique disclosed in Japanese Patent Laid-Open No. 11-135956, a hole is provided in at least one of two overlapping sheet metal pieces, and the edge of the hole is welded to connect the two overlapping sheet metal pieces, and thus a box-shaped frame is formed.

However, in an image forming apparatus including a box-shaped frame having a corner fastened with a screw, loosening of the fastening connection may occur due to vibrations caused during transportation or by an accidental fall, for example. In addition, fixing of the frames by welding requires an additional equipment for welding.

SUMMARY OF THE INVENTION

The present invention provides a frame fastening connection that satisfies both of a reduction in cost and an increase in strength of the frame.

According to an aspect of the present invention, an image forming apparatus includes a housing, wherein the housing includes a plurality of frames, at least one of the plurality of frames is a box-shaped frame with bent portions, the box-shaped frame has a first surface and a second surface overlapping the first surface, the first surface has an insertion portion, the second surface has a receiving portion into which the insertion portion is configured to be inserted, and the first surface and the second surface are connected to each other by insertion of the insertion portion in the receiving portion.

Further features of the present invention will become apparent from the following description of exemplary embodiments with reference to the attached drawings.

DESCRIPTION OF THE EMBODIMENTS

Hereinafter, embodiments of the present invention are described in detail with reference to the drawings for illustrative purposes. Dimensions, materials, shapes or relative positioning of components described in the following embodiments may be suitably changed depending on the configuration of the apparatus to which the present invention is applied or may be varied according to various factors. Therefore, the scope of the present invention is not limited to the description of the embodiments unless otherwise specified.

First Embodiment

A frame fastening connection according to a first embodiment is described with reference to FIGS. 1A and 1B and FIGS. 2A and 2B. Here, a frame fastening connection of one of frames, which make up a framework (housing) of the image forming apparatus, is described as an example.

Configuration of Image Forming Apparatus

Figure 1A:
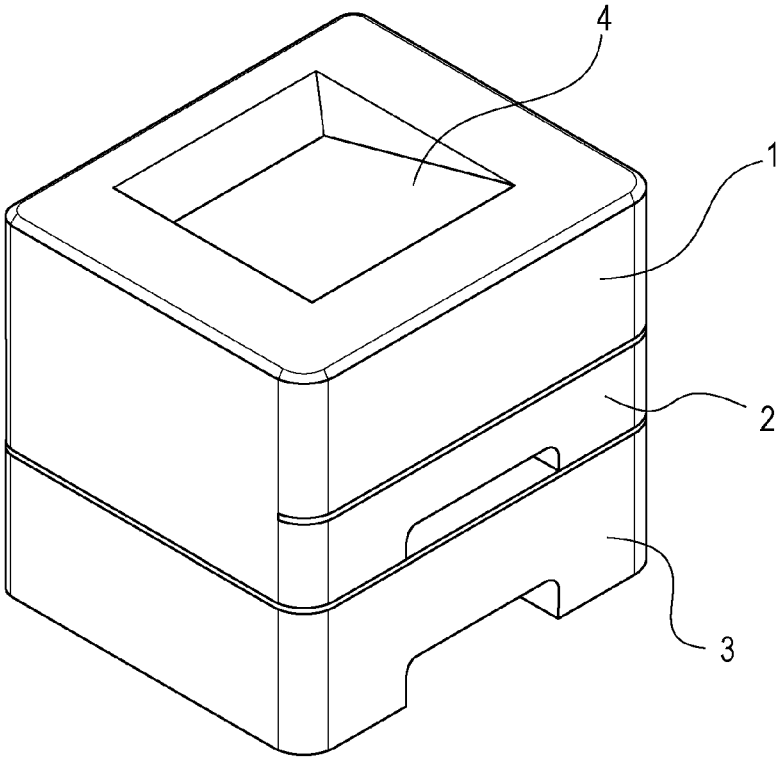
FIG. 1A is a perspective view of an external appearance of an image forming apparatus.
Figure 1B:
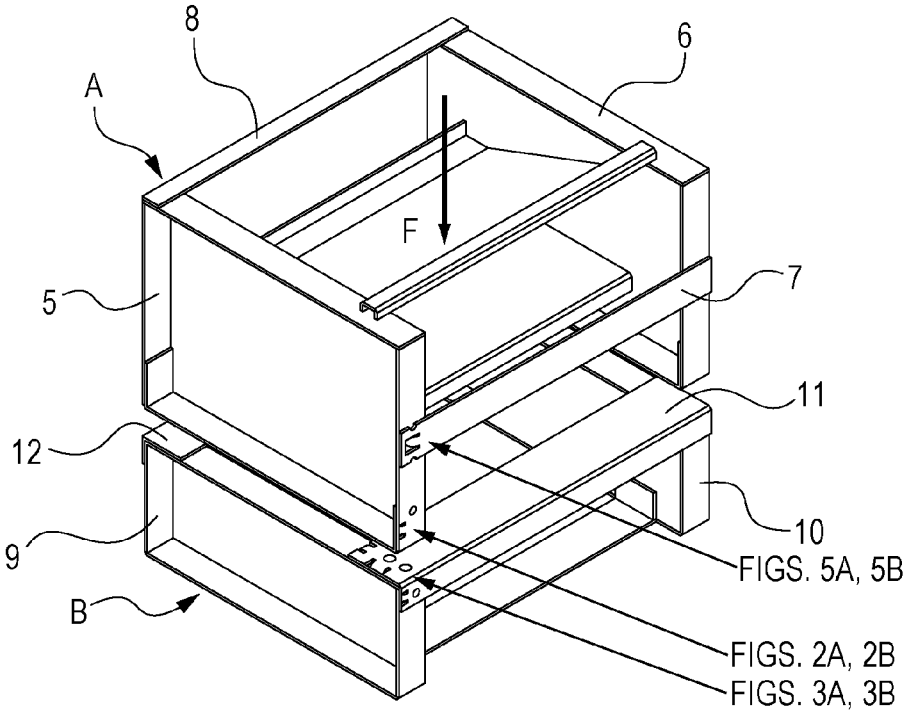
FIG. 1B illustrates a frame construction of the image forming apparatus.

An overall configuration of the image forming apparatus is described with reference to FIGS. 1A and 1B. FIG. 1A is a perspective view of an external appearance of the image forming apparatus. FIG. 1B illustrates a frame construction of the image forming apparatus. Here, a laser beam printer is illustrated as an example of the image forming apparatus. In FIGS. 1A and 1B, a sheet feeder 3, which is used in connection with the image forming apparatus 1, is additionally attached to a lower portion of the image forming apparatus 1.

A cassette 2 configured to house sheets as recording mediums is mounted in the image forming apparatus 1 in such a manner that the cassette 2 is able to be pulled out. Although sheets housed in the cassette 2 are not illustrated, in the image forming apparatus 1, the sheet is transported to an image forming section where an unfixed image is formed, and the unfixed image is transferred to the sheet at an image transfer section. The sheet having the transferred unfixed image is further transported downstream to a fixing section where the unfixed image is fixed onto the sheet with heat and pressure, and then the sheet is ejected to an ejection tray 4.

The image forming apparatus 1 includes a framework (housing) A having a left frame 5, a right frame 6, a front frame 7, and a rear frame 8, for example. The front and rear frames 7 and 8 each connect the left frame 5 with the right frame 6. The left and right frames 5 and 6 each have a box-like shape with corners having bent portions for reinforcement.

The sheet feeder 3 attached to the lower portion of the image forming apparatus 1 includes a framework (housing) B having a left frame 9, a right frame 10, a front frame 11, and a rear frame 12, for example. The front and rear frames 11 and 12 each connect the left frame 9 with the right frame 10.

A weight of the apparatus is always applied to the framework A of the image forming apparatus 1 and the framework B of the sheet feeder 3 in a direction indicated by an arrow F (downward direction) in FIG. 1B.

Configuration of Frame Fastening Connection

Figure 2A:
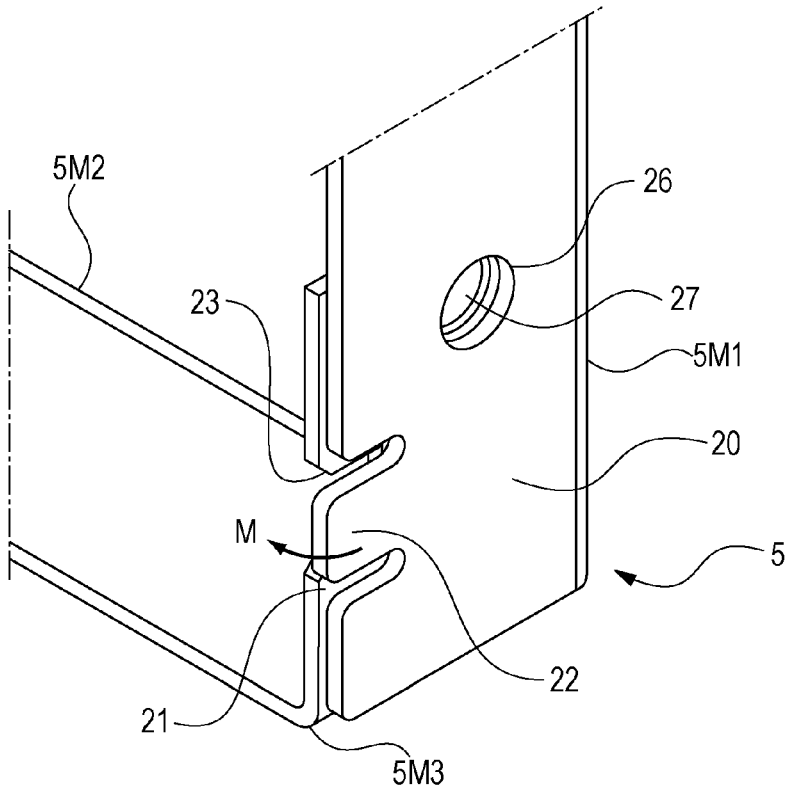
FIGS. 2A and 2B illustrate a frame fastening connection according to a first embodiment.
Figure 2B:
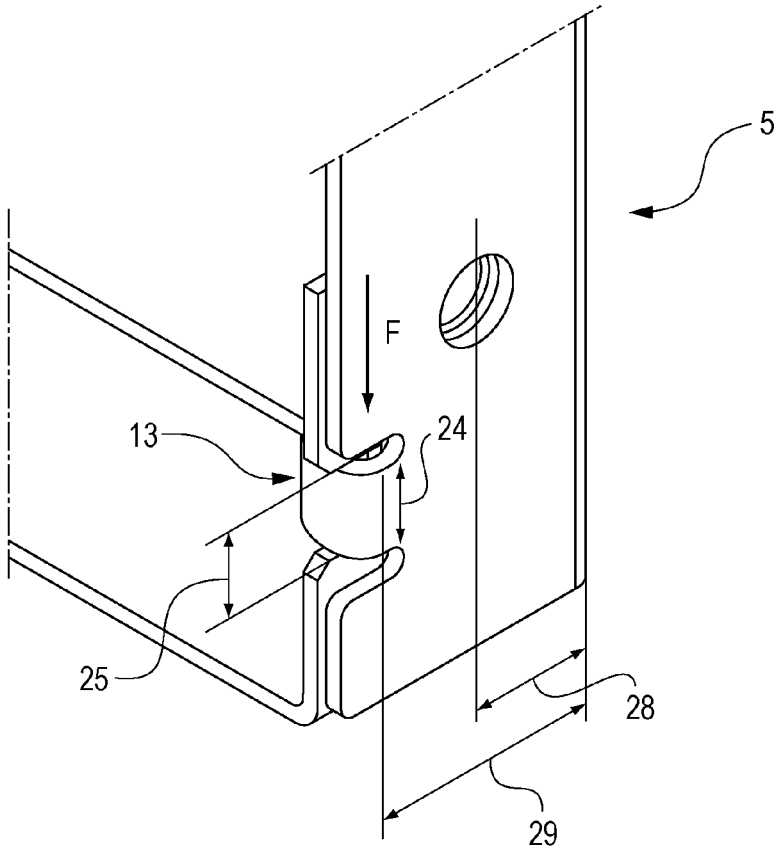

A method of fastening a connection of one of the frames of the framework is described with reference to FIGS. 2A and 2B. Here, a connection of the left frame 5, which is one of the frames of the framework A of the image forming apparatus 1, is described as an example. The right frame 6 of the framework A has the same configuration as the left frame 5 in a symmetrical manner. FIGS. 2A and 2B are magnified views of the corner of the left frame 5. FIG. 2A illustrates a configuration of the left frame 5 before the fastening. FIG. 2B illustrates a configuration of the left frame 5 after the fastening.

As described above, the corner of the left frame 5 has bent portions as illustrated in FIG. 2A for reinforcement. In FIG. 2A, three bent portions 5M1, 5M2, and 5M3 are indicated. A first surface 20 and a second surface 21, which make up the corner of the left frame 5, overlap each other in parallel relation. The first surface 20 has an insertion portion 22, and the second surface 21 has a receiving portion 23 having a U shape into which the insertion portion 22 in a bent state is inserted. The width 24 of the insertion portion 22 and the width 25 of the receiving portion 23 are substantially equal. The first surface 20 has a hole 26. The second surface 21 has a screw hole 27 corresponding to the hole 26 in the first surface 20. A load of the image forming apparatus 1 is applied to a fastening connection between the first surface 20 and the second surface 21 of the left frame 5 (a connection 13 between the insertion portion 22 and the receiving portion 23) in a direction indicated by the arrow F (downward direction in FIG. 1B).

To obtain the frame fastening connection, the insertion portion 22 is bent in a direction indicated by an arrow M in FIG. 2A (a direction intersecting the direction indicated by the arrow F) and inserted into the receiving portion 23. Thus, the force acting on the left frame 5 in a direction indicated by the arrow F is applied to an end face (a ridge line of an end) of the insertion portion 22 in a direction substantially perpendicular to the end face. The load of the apparatus is applied to the insertion portion 22 in a direction of the width 24, reducing deformation of the frame caused by the load applied in the direction indicated by the arrow F.

Screw fastening may be additionally performed to enhance the strength. The screw fastening is performed after the insertion portion 22 is inserted into the receiving portion 23. Since the insertion portion 22 is inserted in the receiving portion 23, a connection between the insertion portion 22 and the receiving portion 23 reduces the possibility that the left frame 5 will deform in a rotational direction due to screw tightening torque caused during the screw fastening.

In addition, the insertion portion 22 inserted in the receiving portion 23 reduces loosening of the screw caused during transportation or by an accidental fall.

When the screw fastening is additionally performed, a positional relationship between the insertion portion 22 and the center of the screw hole 27 can be set as illustrated in FIG. 2B. A distance 29 between the bent portion 5M1 of the left frame 5 and the base of the insertion portion 22 can be longer than a distance 28 between the bent portion 5M1 of the left frame 5 and the center of the screw hole 27.

In the present embodiment, a portion of one of the overlapping surfaces of the frame is bent, and the bent portion is inserted into the other surface. This enables the insertion portion to receive the load on the frame in a direction substantially perpendicular to the end face (ridge line of the end) of the insertion portion inserted in the receiving portion. Thus, the frame receives the load in such a direction that the frame exhibits higher strength, reducing loosening and deformation of the connection.

As described above, the fastening of the overlapping surfaces of the frame of the framework provides both of a reduction in cost and an increase in strength of the frame.

In this embodiment, the receiving portion having the U shape is described as an example. However, the shape of the receiving portion is not limited to the U shape. The receiving portion may be a hole. The receiving portion in the form of a hole provides the same advantages as the receiving portion having the U shape, as described later. In addition, the insertion portion is inserted in the receiving portion in the above-described configuration, but the present invention is not limited thereto. The insertion portion and the receiving portion may be press-fitted to each other as described later.

Second Embodiment

A configuration of a fastening connection between frames according to a second embodiment is described with reference to FIGS. 1A and 1B, FIGS. 3A and 3B, and FIG. 4. Here, a fastening connection between multiple frames, which makes up the framework (housing) of a sheet feeder connected to the image forming apparatus, is described as an example.

Configuration of Frame Fastening Connection

Figure 3A:
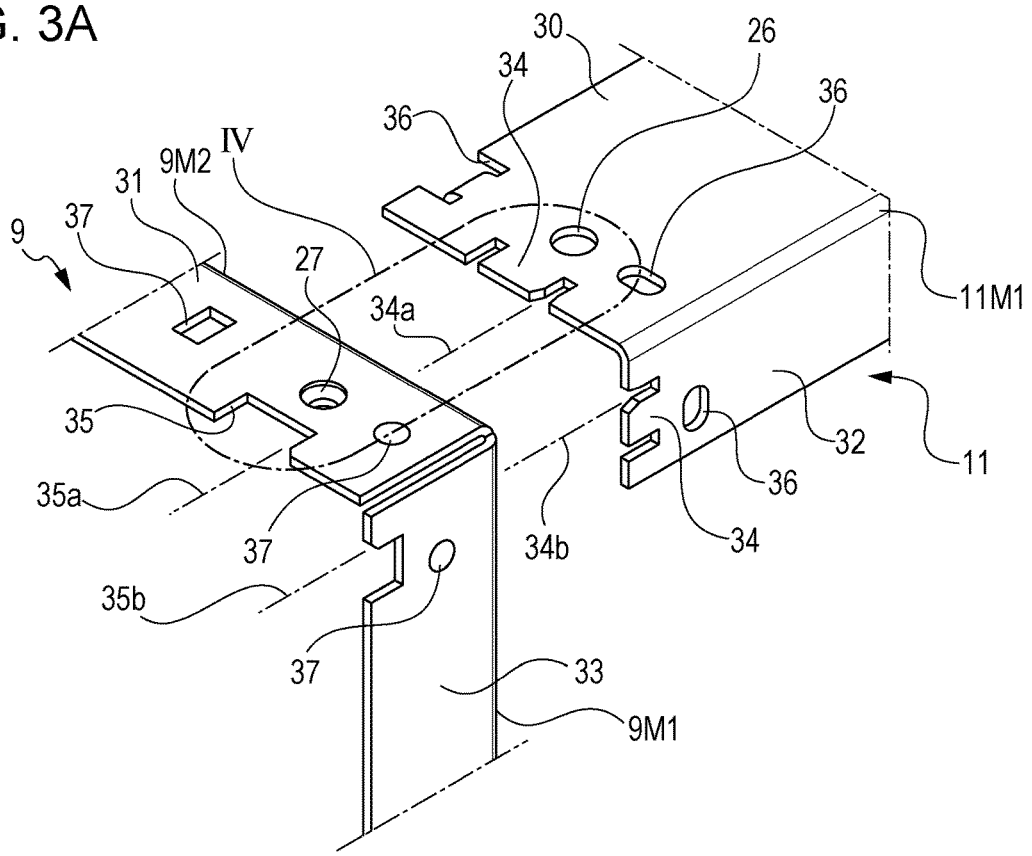
FIGS. 3A and 3B are views illustrating a fastening connection between frames according to a second embodiment.
Figure 3B:
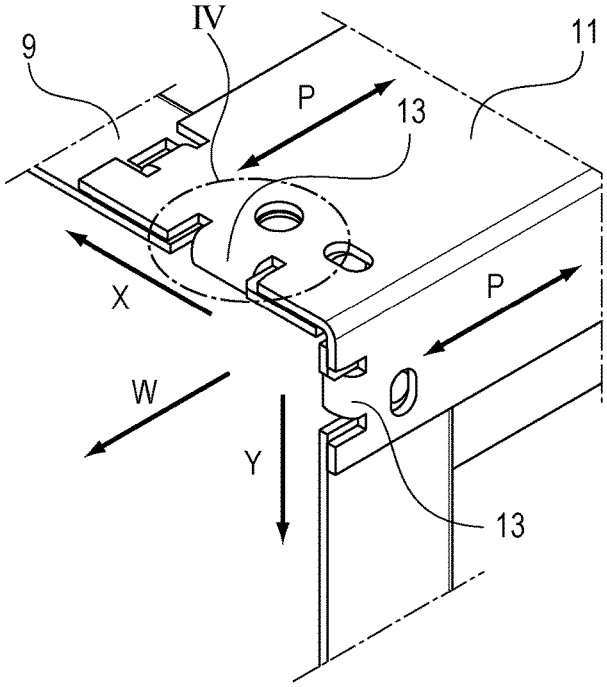
Figure 4:
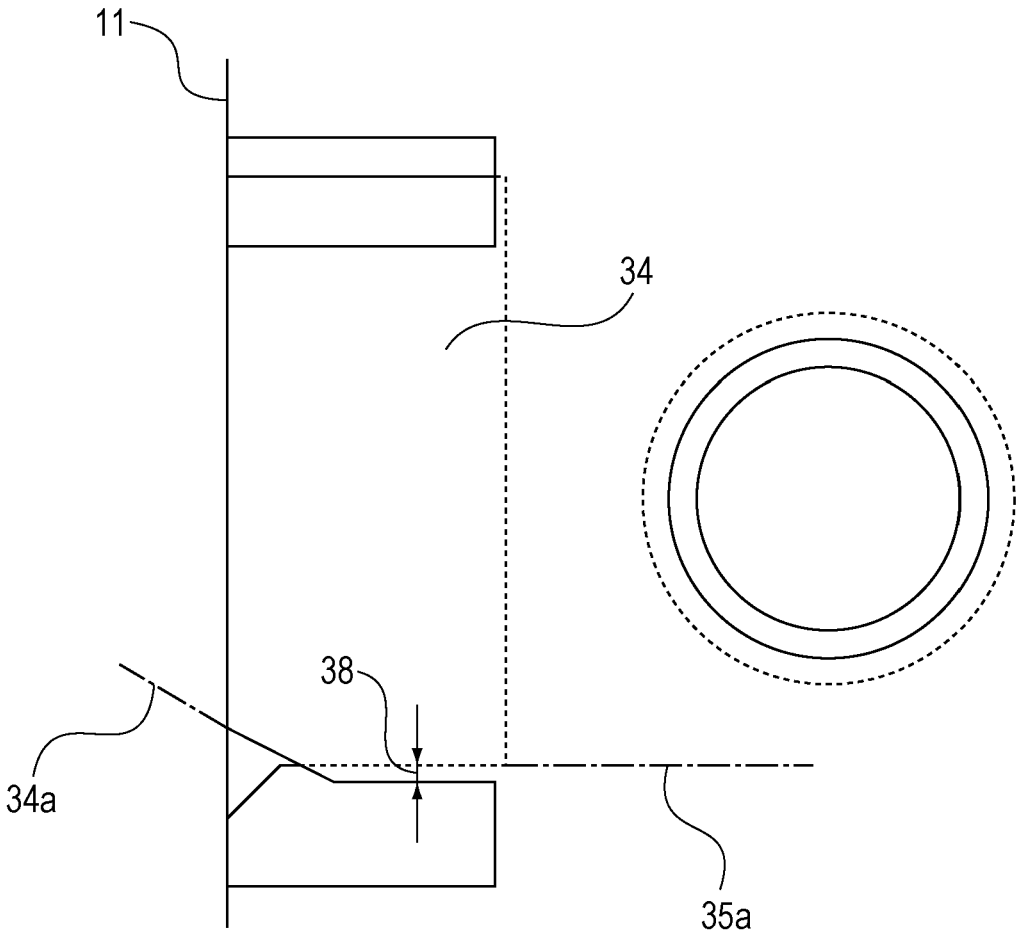
FIG. 4 is a detail view of the fastening connection between the frames according to the second embodiment.

A method of fastening a connection between multiple frames of the framework is described with reference to FIGS. 3A and 3B. Here, a connection between a left frame 9 (second frame) and a front frame 11 (first frame) of the plurality of frames, which make up the framework B of the sheet feeder 3, is described as an example. A right frame 10 of the framework B, which is connected to the front frame 11, has the same configuration as the left frame 9 in a symmetrical manner. FIGS. 3A and 3B are magnified views of the connection between the left frame 9 and the front frame 11. FIG. 3A illustrates the configuration of the left and front frames 9 and 11 before the fastening. FIG. 3B illustrates the configuration of the left and front frames 9 and 11 after the fastening. FIG. 4 is a magnified view of a fastening connection IV between the left and front frames 9 and 11 indicated in FIGS. 3A and 3B.

The corner of the left frame 9 has bent portions as illustrated in FIG. 3A for reinforcement as in the left frame 5. The front frame 11 covers the corner of the left frame 9 and is fastened thereto in an overlapping state. Reference numerals 9M1 and 9M2 indicate bent portions of the left frame 9, and 11M1 indicates a bent portion of the front frame 11.

The corner of the left frame 9 (second frame) has the bent portions 9M2 and 9M1 so as to have two second surfaces 31 and 33. The front frame 11 (first frame) covering the corner of the left frame 9 has the bent portion 11M1 so as to have two first surfaces 30 and 32. The first surfaces 30 and 32 overlap the second surfaces 31 and 33 of the left frame 9, respectively.

The first surface 30 of the front frame 11 and the second surface 31 of the left frame 9 overlap each other in parallel relation, and the first surface 32 of the front frame 11 and the second surface 33 of the left frame 9 overlap each other in parallel relation. The first surface 30 of the front frame 11 has an insertion portion 34. The second surface 31 of the left frame 9 has a receiving portion 35 having a U shape into which the insertion portion 34 in a bent state is inserted. In the same manner, the first surface 32 of the front frame 11 has an insertion portion 34, and the second surface 33 of the left frame 9 has a receiving portion 35 having a U shape into which the insertion portion 34 in a bent state is inserted.

The second surfaces 31 and 33 include positioning portions 37. The first surfaces 30 and 32 include positioning portions 36 at positions corresponding to the positioning portions 37. To connect the left frame 9 with the front frame 11, the positioning portions 36 and the corresponding positioning portions 37 are aligned to determine the position of the front frame 11 with respect to the left frame 9. In FIG. 3A and FIG. 3B, the positioning portions 36 and 37 determine the position of the front frame 11 with respect to the left frame 9 in a direction indicated by an arrow P.

FIG. 4 is a magnified view of the fastening connection IV between the left frame 9 and the front frame 11 illustrated in FIG. 3A and FIG. 3B. FIG. 4 illustrates a positional relationship between the insertion portion 34 and the receiving portion 35 of the overlapping left and front frames 9 and 11 before the fastening.

A side ridge line 34*a* of the insertion portion 34 extends diagonally such that the insertion portion 34 is wider at the base than at the front portion. A side ridge line 35*a* of the receiving portion 35 intersects the side ridge line 34*a* of the insertion portion 34 such that an overlapping amount 38 is obtained.

To connect the left frame 9 with the front frame 11, the insertion portion 34 of the first surface 30, which is one of the first surfaces, of the front frame 11 is bent, and the bent insertion portion 34 is inserted into the receiving portion 35 of the second surface 31, which is one of the second surfaces, of the left frame 9. During the insertion, the side ridge line 34*a* of the insertion portion 34 gradually comes in contact with the side ridge line 35*a* of the receiving portion 35, and force is applied to the front frame 11 in a direction indicated by an arrow X in FIG. 3B with respect to the left frame 9. The press-fitting of the insertion portion 34 into the receiving portion 35 causes the first surface 32, which is the other of the first surfaces, of the front frame 11 and the second surface 33, which is the other of the second surfaces, of the left frame 9 to be in close contact with each other.

Then, the insertion portion 34 of the first surface 32 of the front frame 11 is bent, and the bent insertion portion 34 is inserted into the receiving portion 35 of the second surface 33 of the left frame 9. In the same manner as described above, a side ridge line 34*b* of the insertion portion 34 gradually comes in contact with a side ridge line 35*b* of the receiving portion 35, and force is applied to the front frame 11 in a direction indicated by an arrow Y in FIG. 3B with respect to the left frame 9. The press-fitting of the insertion portion 34 into the receiving portion 35 causes the first surface 30 of the front frame 11 and the second surface 31 of the left frame 9 to be in close contact with each other.

The positions of connection between the first surfaces 30 and 32 and the second surfaces 31 and 33, which overlap each other, are determined by the above-described contact between the end of each of the bent insertion portions 34 and the end of each of the corresponding receiving portions 35.

As described above, the force is applied to the press-fitted insertion portion 34 of the first surface 30 in the direction indicated by the arrow X, and the force is applied to the press-fitted insertion portion 34 of the first surface 32 in the direction indicated by the arrow Y (FIG. 3B). As a result, the resultant force acts (in a direction indicated by an arrow W in FIG. 3B) such that the front frame 11 comes in close contact with the left frame 9.

The above-described configuration enables two components to be fastened together without a screw. In addition, the frames are able to support a load at the fastening connections (the connections 13 between each of the insertion portions 34 and the corresponding one of the receiving portions 35) for the reason described in the first embodiment.

Screw fastening may be additionally performed to enhance the strength. The fastening is performed after the insertion portion 34 is inserted into the receiving portion 35. The insertion portion 34 inserted into the receiving portion 35 reduces the possibility that the frame will deform in a rotational direction due to screw tightening torque caused during the screw fastening.

In addition, the insertion portion 34 inserted in the receiving portion 35 reduces loosening of the screw caused during transportation or by an accidental fall.

In the present embodiment, a portion of the first surface of the overlapping frames is bent, and the bent portion is inserted into the second surface of the overlapping frames. This enables the insertion portion to receive the load on the frames in a direction substantially perpendicular to the ridge line of the insertion portion inserted in the receiving portion. Thus, the frame receives the load in such a direction that the frame exhibits higher strength, reducing loosening or deformation of the fastening connection. In addition, the press fitting of the frames enables the frames to be fastened together without backlash.

The above-described fastening of the adjacent surfaces of the frames of the framework provides both of a reduction in cost and an increase in strength of the frames. In addition, in this embodiment, the two frames are fastened together at a plurality of surfaces of each frame, and the fastening of the corresponding first and second surfaces of the frames brings another corresponding first and second surfaces of the frames into close contact with each other. This particularly provides the above-described advantages.

In this embodiment, the receiving portion having a U shape is described as an example, but the shape of the receiving portion is not limited to the U shape. The receiving portion may be a hole as described later. The receiving portion in the form of a hole also provides the above-described advantages.

In this embodiment, one ridge line of the insertion portion extends diagonally so as to intersect one ridge line of the corresponding receiving portion. However, any one of the insertion portion and the receiving portion may have a diagonal ridge line as long as the insertion portion and the receiving portion are press-fitted to each other.

In this embodiment, the receiving portion is formed of a sheet metal frame. However, the receiving portion may be formed of a resin frame.

Third Embodiment

A fastening connection between multiple frames according to a third embodiment is described with reference to FIGS. 1A and 1B, FIGS. 5A and 5B, FIGS. 6A and 6B, and FIG. 7. Here, a fastening connection between multiple frames, which make up a framework (housing) of an image forming apparatus, is described as an example. Components identical to those described above are assigned the same reference numerals as those described above and are not described.

Configuration of Frame Fastening Connection

Figure 5B:
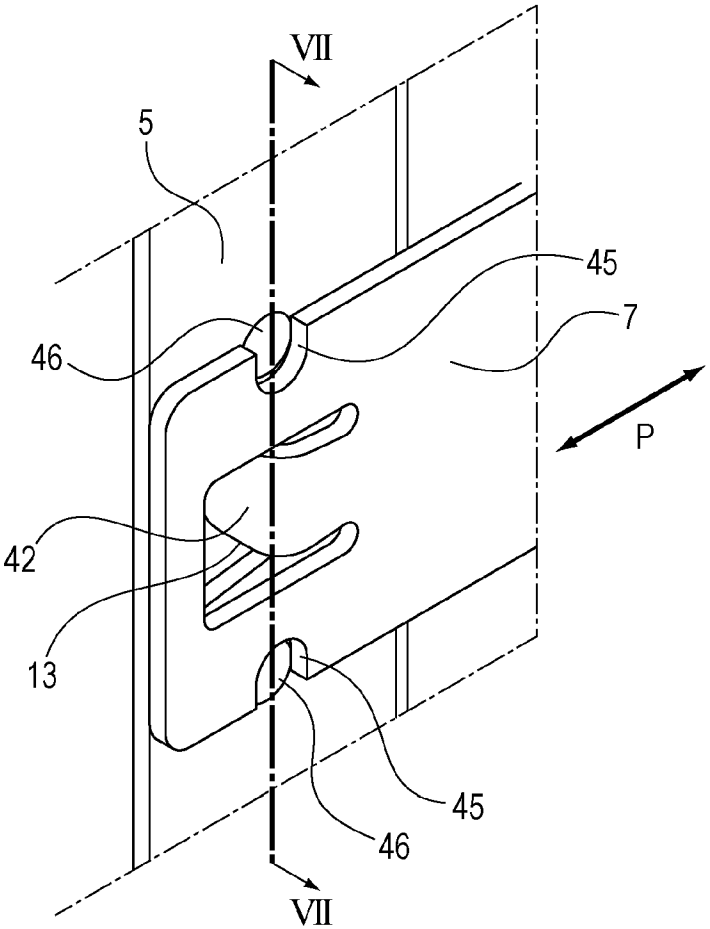
FIGS. 5A and 5B illustrate a fastening connection between frames according to a third embodiment.
Figure 5A:
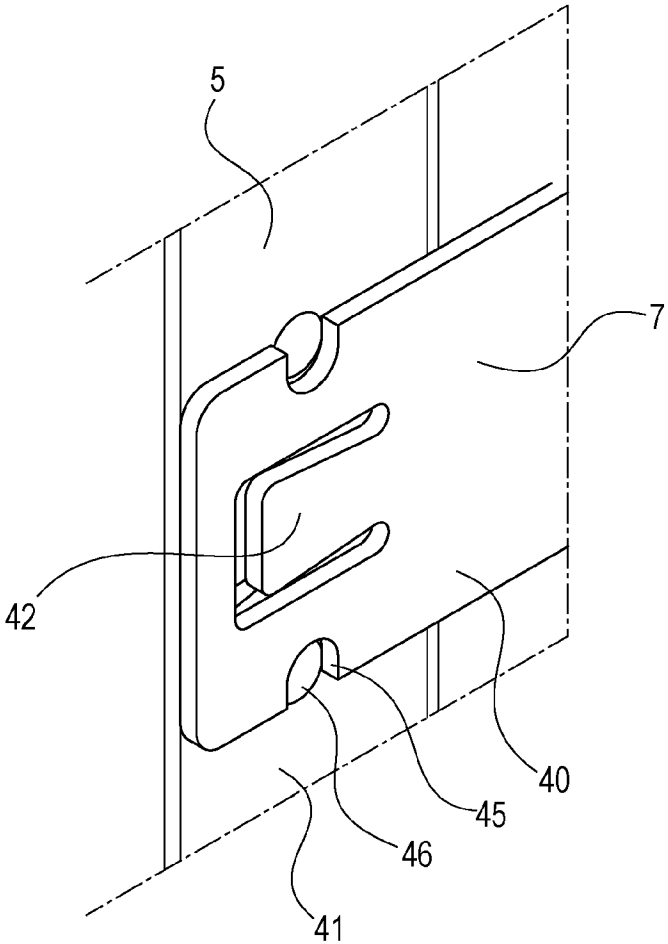
Figure 6A:
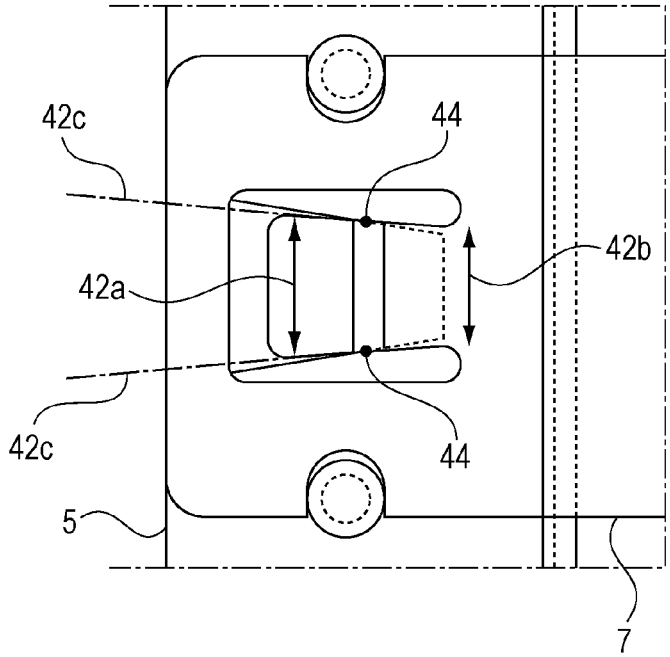
FIGS. 6A and 6B illustrate the fastening connection between the frames according to the third embodiment.
Figure 6B:
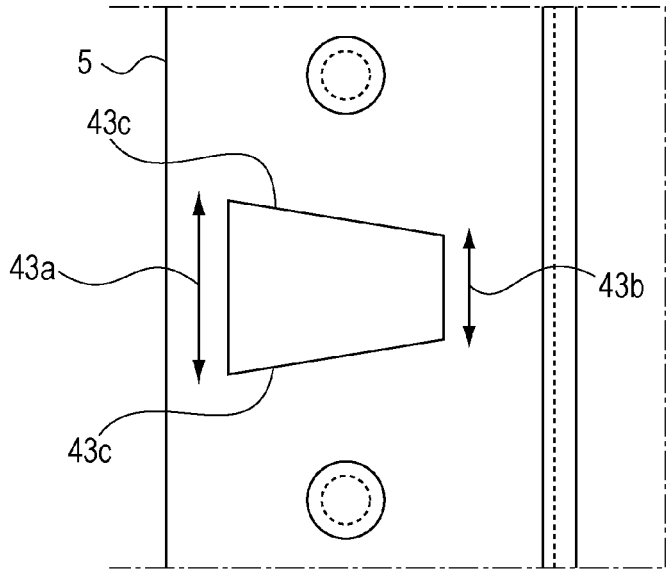
Figure 7:
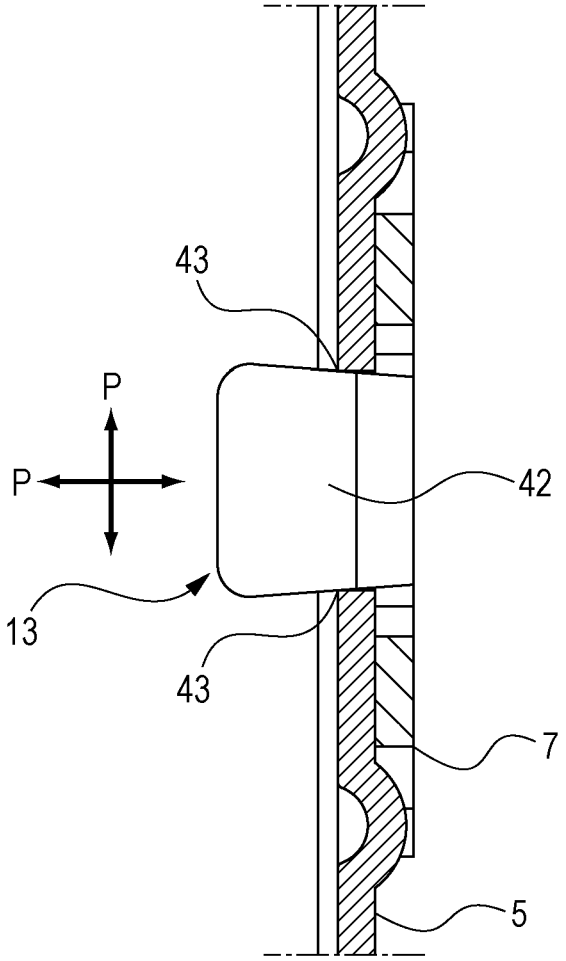
FIG. 7 is a cross-sectional view illustrating the fastening connection between the frames according to the third embodiment.

With reference to FIGS. 5A and 5B, FIGS. 6A and 6B, and FIG. 7, a method of fastening a connection between multiple frames of a framework is described. Here, the left frame 5 and the front frame 7, which are included in the multiple frames making up the framework A of the image forming apparatus 1, are described, for example. The right frame 6 of the framework A has the same configuration as the left frame 5 in a symmetrical manner. FIG. 5A illustrates the connection between the left frame 5 and the front frame 7 before the fastening. FIG. 5B illustrates the connection between the left frame 5 and the front frame 7 after the fastening. FIG. 6A and FIG. 6B illustrate the connection between the left and front frames 5 and 7 before the fastening in detail. FIG. 7 is a cross-sectional view taken along line VII-VII in FIG. 5B and illustrates a cross section of the connection between the left and front frames 5 and 7 after the fastening. The connection between the left and front frames 5 and 7, which is described later, is a connection 13 in which an insertion portion 42 of a first surface of one of the frames is connected to a receiving portion 43 of the second surface of the other of the frames.

As described above, the corner of the left frame 5 has the bent portions for reinforcement as illustrated in FIG. 1B. A surface of the front frame 7 is fastened to one of the surfaces of the left frame 5 having the bent portions while the surfaces overlap each other in parallel relation (FIG. 5A and FIG. 5B).

A first surface 40 of the front frame 7 (first frame) and a second surface 41 of the left frame 5 (second frame) overlap each other in parallel relation. The first surface 40 of the front frame 7 has the insertion portion 42. The second surface 41 of the left frame 5 has the receiving portion 43 in the form of a hole to which the insertion portion 42 in a bent state is inserted. As illustrated in FIG. 6A, a ridge line 42*c* at each side of the insertion portion 42 extends diagonally such that a front end width 42*a* is larger than a base width 42*b*. A ridge line 43*c* at each side of the receiving portion 43 extends diagonally such that a front end width 43*a* is larger than a base width 43*b*. The front end width 43*a* is a width at a position corresponding to the front end side of the insertion portion 42, and the base width 43*b* is a width at a position corresponding to the base side of the insertion portion 42. A ridge line 42*c* of the insertion portion 42 intersects a ridge line 43*c* of the receiving portion 43 in a state that the first surface 40 of the front frame 7 overlaps the second surface 41 of the left frame 5. In FIG. 6A, the ridge line 42*c* at each side of the insertion portion 42 and the ridge line 43*c* at each side of the receiving portion 43 intersect at intersections 44.

As illustrated in FIG. 5A, the first surface 40 of the front frame 7 has positioning grooves 45, and the second surface 41 of the left frame 5 has positioning bosses 46 at positions corresponding to the positioning grooves 45. To connect the front and left frames 7 and 5, the positioning grooves 45 and the corresponding bosses 46 are fitted together to position the front frame 7 with respect to the left frame 5. In FIG. 5B, the positioning grooves 45 and the bosses 46 position the front frame 7 with respect to the left frame 5 in a direction indicated by an arrow P.

To fasten the left and front frames 5 and 7, the insertion portion 42 is bent, and the bent insertion portion 42 is inserted into the receiving portion 43 (FIG. 5B). During the insertion, the ridge line 42*c* at each side of the insertion portion 42 gradually comes in contact with the ridge line 43*c* at each side of the receiving portion 43, and the insertion portion 42 is press-fitted into the receiving portion 43 (FIG. 7). This limits the movement of the press-fitted insertion portion 42 of the first surface 40 in the direction indicated by the arrow P in FIG. 7. Thus, the front frame 7 and the left frame 5 are closely fastened together.

Screw fastening may be additionally performed to enhance the strength. The screw fastening is performed after the insertion portion 42 is inserted into the receiving portion 43. The insertion portion 42 inserted into the receiving portion 43 reduces the possibility that the frames will deform in a rotational direction due to screw tightening torque caused during the screw fastening.

In addition, the insertion portion 42 inserted into the receiving portion 43 reduces loosening of the screw caused during transportation or by an accidental fall.

In this embodiment, a portion of one of the overlapping surfaces of the frames is bent, and the bent portion is inserted into the other of the overlapping surfaces. This enables the insertion portion to receive the load on the frames in a direction substantially perpendicular to the ridge line of the insertion portion inserted in the receiving portion. The frames receive the load in such a direction that the frame exhibits higher strength, reducing the loosening and the deformation of the connection. In addition, the press fitting of the bent portion enables the frames to be fastened together without backlash.

The above-described fastening of the overlapping surfaces of the frames of the framework provides both of a reduction in cost and an increase in strength of the frames.

In this embodiment, the receiving portion in the form of a hole is described as an example, but the shape of the receiving portion is not limited to the hole. The receiving portion may have the U shape as described above, i.e., may be a U shaped notch. The U shaped notch also provides the above-described advantages. In addition, the frame having the receiving portion is a sheet metal frame in this embodiment, but the frame may be a resin frame.

Other Embodiments

In the above-described embodiments, a printer is described as an example of the image forming apparatus, but the present invention is not limited to the printer. The image forming apparatus may be a copier, facsimile, multifunctional device which incorporates the functionality of multiple devices in one, or any other image forming apparatus. In addition, a sheet feeder is described as an example of the sheet transfer apparatus connected to the image forming apparatus, but the present invention is not limited to the sheet feeder. The sheet transfer apparatus may be a sheet processing apparatus, sheet ejector, or any other sheet transfer apparatus, which is connected to the image forming apparatus. For example, examples of the sheet transfer apparatus include a sheet feeder, a sheet ejector, and a sheet processing apparatus, which are peripheral devices connected to the image forming apparatus. The present invention also provides the above-described advantages when applied to a fastening connection between frames of a framework of any of the above-described image forming apparatus or any of the sheet transfer apparatus, which is a peripheral device connected to the image forming apparatus.

In addition, in the above-described embodiments, the sheet transfer apparatus configured to transfer sheets such as a recoding sheet to which an image is printed is described as an example. However, the present invention is not limited to such a sheet transfer apparatus. The present invention also provides the above-described advantages when applied to a sheet transfer apparatus configured to transfer an object for scanning such as a document.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-138440, filed Jul. 10, 2015, which is hereby incorporated by reference herein in its entirety.

What is claimed is:

1. An image forming apparatus comprising:

an image forming portion for forming an image on a sheet;

a first frame, having a first surface portion, for supporting the image forming portion; and a second frame having a second surface portion contacting the first surface portion, wherein the first surface portion has first and second insertion portions, the second surface portion has first and second receiving portions into which the first and second insertion portions are configured to be inserted respectively, the first insertion portion is bent in a first direction which crosses the second surface portion, and the second insertion portion is bent in a second direction which crosses the second surface portion and the first direction, and wherein the first surface portion further includes a surface hole, the second surface portion further includes a screw hole, and the surface hole is sandwiched between a screw and the screw hole.

2. The image forming apparatus according to claim 1, wherein the first insertion portion is configured to be in a first orientation that is parallel to a surface of the first frame and a second orientation that is angled to the surface of the first frame, and wherein the first frame and the second frame are connected to each other when the first insertion portion is angled to the surface and positioned within the first receiving portion.

3. The image forming apparatus according to claim 1, wherein the second frame includes an interior surface configured to guide a sheet feeder as a sheet transfer apparatus into and out of the image forming apparatus.

4. The image forming apparatus according to claim 1, wherein the first receiving portion has a U-shape.

5. The image forming apparatus according to claim 1, wherein a width of the first insertion portion is greater than a width of the first receiving portion by a predetermined overlapping amount.

6. The image forming apparatus according to claim 5, wherein the first insertion portion includes a side ridge line that extends diagonally relative to a front portion of the first insertion portion such that a base of the insertion portion is wider than the front portion of the first insertion portion, and wherein a width of the front portion of the first insertion portion is less than the width of the first receiving portion such that the front portion is configured to guide the first insertion portion into the first receiving portion so that the first insertion portion is press-fit into the receiving portion.

7. The image forming apparatus according to claim 1, wherein the second insertion portion is configured to be in a first orientation that is parallel to the second surface portion of the first frame and a second orientation that is angled to the second surface portion of the first frame, and wherein the first frame and the second frame are connected to each other when (i) the first insertion portion is angled to the first surface portion and positioned within the first receiving portion and (ii) the second insertion portion is angled to the second surface portion and positioned within the second receiving portion.

8. The image forming apparatus according to claim 1, wherein a distance between a first bent portion of the second frame and a base of the insertion portion is longer than a distance between the first bent portion and a center of the screw hole.

9. An image forming apparatus comprising:

an image forming portion for forming an image on a sheet;

a first frame, having a first surface portion, for supporting the image forming portion; and a second frame having a second surface portion contacting the first surface portion, wherein the first surface portion has an insertion portion, the second surface portion has a receiving portion into which the insertion portion is configured to be inserted, and the insertion portion is bent in a first direction which crosses the second surface portion, wherein, a part of the insertion portion and a part of the second surface portion are overlapped in the first direction before the insertion portion is bent in the first direction, and wherein the first surface portion further includes a surface hole, the second surface portion further includes a screw hole, and the surface hole is sandwiched between a screw and the screw hole.

10. The image forming apparatus according to claim 9, wherein the second frame is a box-shaped frame, the second frame includes a plurality of bent portions, wherein the insertion portion is configured to be in a first orientation that is parallel to the first surface portion and a second orientation that is angled to the first surface portion, and wherein the first surface portion and the second surface portion are connected to each other when the insertion portion is angled to the first surface portion and positioned within the receiving portion.

11. The image forming apparatus according to claim 9, further comprising an interior surface configured to guide a paper cassette housing sheets into and out of the image forming apparatus.

12. The image forming apparatus according to claim 9, wherein the receiving portion has a U-shape.

13. The image forming apparatus according to claim 9, wherein a width of the insertion portion and a width of the receiving portion are substantially equal.

14. The image forming apparatus according to claim 9, wherein the insertion portion angled to the first surface portion and positioned within the receiving portion forms a frame fastening connection configured to (i) resist deformation to the box-shaped frame caused by torque force from the screw to the surface hole when the screw is in the screw hole and (ii) resist transportation forces applied to the image forming apparatus that cause loosening of the screw.

15. The image forming apparatus according to claim 14, wherein a distance between a first bent portion of the box-shaped frame and a base of the insertion portion is longer than a distance between the first bent portion and a center of the screw hole.

16. The image forming apparatus according to claim 9, wherein the screw is a first screw and the screw hole is a first screw hole, the image forming apparatus further comprising a second screw, wherein the second surface portion further includes a second screw hole, and the receiving portion is located between the first and second screw holes.

17. An image forming apparatus comprising:

first and second screws;

an image forming portion for forming an image on a sheet;

a first frame, having a first surface portion, for supporting the image forming portion; and a second frame having a second surface portion contacting the first surface portion, wherein the first surface portion has an insertion portion, the second surface portion has a receiving portion into which the insertion portion is configured to be inserted, and the insertion portion is bent in a first direction which crosses the second surface portion, wherein, a part of the insertion portion and a part of the second surface portion are overlapped in the first direction before the insertion portion is bent in the first direction, wherein the first surface portion further includes a surface hole, the second surface portion further includes a screw hole, and the surface hole is sandwiched between the screw and the screw hole, and wherein the second surface portion further includes first and second screw holes, and the receiving portion is located between the first and second screw holes.

* * * * *